US010089827B2

(12) United States Patent
Froy et al.

(10) Patent No.: US 10,089,827 B2
(45) Date of Patent: Oct. 2, 2018

(54) ENHANCED ELECTRONIC GAMING MACHINE WITH GAZE-BASED POPUP MESSAGING

(71) Applicant: IGT CANADA SOLUTIONS ULC, Moncton (CA)

(72) Inventors: David Froy, Lakeville-Westmorland (CA); Edward Bowron, Shediac Bridge (CA); Reuben Dupuis, Moncton (CA); Vicky Leblanc, Moncton (CA); Karen Van Niekerk, Dieppe (CA); Christopher Spurrell, Boundary Creek (CA)

(73) Assignee: IGT CANADA SOLUTIONS ULC, Moncton (CA)

( * ) Notice: Subject to any disclaimer, the term of this patent is extended or adjusted under 35 U.S.C. 154(b) by 0 days.

(21) Appl. No.: 14/966,836

(22) Filed: Dec. 11, 2015

(65) Prior Publication Data

US 2017/0169664 A1 Jun. 15, 2017

(51) Int. Cl.
*G07F 17/32* (2006.01)
*G07F 17/34* (2006.01)

(52) U.S. Cl.
CPC ..... *G07F 17/3262* (2013.01); *G07F 17/323* (2013.01); *G07F 17/3209* (2013.01); *G07F 17/3211* (2013.01); *G07F 17/3225* (2013.01); *G07F 17/3239* (2013.01); *G07F 17/3246* (2013.01); *G07F 17/3255* (2013.01); *G07F 17/3269* (2013.01); *G07F 17/3286* (2013.01)

(58) Field of Classification Search
None
See application file for complete search history.

(56) References Cited

U.S. PATENT DOCUMENTS

| | | | | |
|---|---|---|---|---|
| 6,222,465 | B1 | 4/2001 | Kumar et al. | |
| 7,815,507 | B2 | 10/2010 | Parrott et al. | |
| 8,885,882 | B1 * | 11/2014 | Yin | G06F 3/00 382/103 |
| 2013/0044291 | A1 * | 2/2013 | Kato | A61B 3/0025 351/209 |
| 2013/0225268 | A1 * | 8/2013 | Caputo | G07F 17/323 463/25 |
| 2014/0235318 | A1 * | 8/2014 | De Viveiros Ortiz | G07F 17/3267 463/19 |
| 2014/0323194 | A1 * | 10/2014 | Keilwert | G07F 17/3206 463/16 |
| 2015/0348358 | A1 * | 12/2015 | Comeau | G07F 17/34 463/20 |

* cited by examiner

*Primary Examiner* — Robert T Clarke, Jr.
(74) *Attorney, Agent, or Firm* — Sage Patent Group

(57) ABSTRACT

An electronic gaming machine is provided. The computer device comprises at least one data storage unit storing game data for a game, a display unit to display graphical game components to a player of the game, at least one data capture unit, such as a camera, to collect data about the player's gaze, and a processor to process the player gaze data, determine if a player gaze condition is satisfied, determine whether a game condition is satisfied. If both the player gaze condition and the game condition are satisfied, the processor modifies at least some of the graphical game components based on the player gaze condition and the game condition.

4 Claims, 11 Drawing Sheets

ENHANCED ELECTRONIC GAMING MACHINE WITH GAZE-BASED POPUP MESSAGING

TECHNICAL FIELD

The present application is generally drawn to electronic gaming systems, and more specifically to manipulating game components or interface in response to a player's body movements.

BACKGROUND OF THE ART

Many different video gaming systems or machines exist, and may consist of slot machines, online gaming systems (that enable players to play games using computer devices, whether desktop computers, laptops, tablet computers or smart phones), computer programs for use on a computer device (including desktop computer, laptops, tablet computers of smart phones), or gaming consoles that are connectable to a display such as a television or computer screen.

Video gaming machines may be configured to enable players to play a variety of different types of games. One type of game displays a plurality of moving arrangements of gaming elements (such as reels, and symbols on reels), and one or more winning combinations are displayed using a pattern of gaming elements in an arrangement of cells (or an "array"), where each cell may include a gaming element, and where gaming elements may define winning combinations (or a "winning pattern").

Games that are based on winning patterns may be referred to as "pattern games" in this disclosure.

One example of a pattern game is a game that includes spinning reels, where a player wagers on one or more lines, activates the game, and the spinning reels are stopped to show one or more patterns in an array. The game rules may define one or more winning patterns of gaming elements, and these winning patterns may be associated with credits, points or the equivalent.

Another example type of game may be a maze-type game where the player may navigate a virtual character through a maze for prizes.

A further example type of game may be a navigation-type game where a player may navigate a virtual character to attempt to avoid getting hit by some moving or stationary objects and try to contact other moving or stationary objects.

Gaming systems or machines of this type are popular; however, there is a need to compete for the attention of players by innovating with the technology used to implement the games.

SUMMARY

An electronic gaming machine is provided. The computer device comprises at least one data storage unit storing game data for a game, a display unit to display graphical game components to a player of the game, at least one data capture unit, such as a camera, to collect data about the player's gaze, and a processor to process the player gaze data, determine if a player gaze condition is satisfied, determine whether a game condition is satisfied. If both the player gaze condition and the game condition are satisfied, the processor modifies at least some of the graphical game components based on the player gaze condition and the game condition.

In accordance with a broad aspect, embodiments described herein relate to computer-implemented devices, systems and methods for moving game components that may involve displaying game components using various graphical enhancements. The gaming surface may be provided as a three-dimensional environment with various points of view. The devices, systems and method may involve tracking player movement and updating the three-dimensional point of view based on the tracked player movement. The devices, systems and method may involve tracking player movement and updating three-dimensional objects, virtual characters or avatars, gaming components, or other aspects of the gaming surface in response. For example, the devices, systems and method may involve tracking a player's eyes so that when the eyes move the virtual characters, gaming components, gaming surface, or other object moves in response. The player may navigate virtual characters through a game with body and eye movements. Tracking the player's may manipulate gaming objects based on body and eye movements. The player's movements may also relate to particular gestures.

In accordance with another broad aspect, the graphical enhancement may involve displaying multi-faceted game components as a three-dimensional configuration. The devices, systems and method may involve tracking player movement, including eye movements, and rotating the multi-faceted game components in response to tracked movement. The rotation may be on different axis, such as vertical, horizontal or at an angle to a plane of the game surface or display device. The rotation may enable a player to view facets that may be hidden from a current view. The devices, systems and method may involve tracking player movement and updating the point of view of the graphical enhancement multi-faceted game components in response.

In accordance with further broad aspect, there is provided an electronic gaming device for displaying graphical game components to a player of an electronic gaming machine. The electronic gaming device comprises at least one data storage unit to store game data for a game, the game data comprising at least one game condition and at least one player gaze condition; a display unit to display, via a graphical user interface, the graphical game components in accordance with the game data; at least one data capture unit to collect player gaze data representative of a gaze of the player, the data capture device comprising a camera; and at least one processor. The processor is configured to process the player gaze data to determine whether at least one player gaze condition is satisfied; if at least one player gaze condition is satisfied, determine whether at least one game condition is satisfied; and if at least one game condition is satisfied, modify at least some of the graphical game components on the display unit based on the at least one satisfied game condition and at least one satisfied player gaze condition.

In some embodiments, modifying the at least some of the graphical game components on the display unit comprises overlaying a help screen over at least part of the at least some graphical game components.

In some embodiments, the player gaze condition is satisfied by the player staring at the screen for an predetermined period of time, and wherein modifying the at least some graphical game components on the display unit comprises displaying attention-drawing graphical game components.

In some embodiments, the at least one game condition comprises the player having credit remaining in the electronic gaming device.

In some embodiments, modifying at least some graphical game components on the display unit comprises altering a duration of a timeout timer.

In some embodiments, the player gaze condition is satisfied by the player staring at the screen for an predetermined period of time, and wherein modifying at least some graphical game components on the display unit comprises displaying a message on the display unit.

In some embodiments, the message is a responsible gaming message.

In some embodiments, the message is an advertisement.

In accordance with further broad aspect, there is provided an electronic gaming device for displaying graphical game components to a player of an electronic gaming machine. The electronic gaming device comprises at least one data storage unit to store game data for a game, the game data comprising at least one game condition and at least one player gaze condition; first and second display units to display, via a shared graphical user interface, the graphical game components in accordance with the game data; at least one data capture unit to collect player gaze data representative of a gaze of the player, the data capture device comprising a camera; and at least one processor. The processor is configured to process the player gaze data to determine whether the player is looking at a particular graphical game component displayed on the first display unit; if player is looking at the particular graphical game component, determine whether at least one game condition is satisfied; and if at least one game condition is satisfied, display at least one further graphical game component on the second display unit, the at least one further graphical game component selected based on the at least one satisfied game condition.

In some embodiments, the particular graphical game component is a bonus game indicator, and the at least one further graphical game component is a bonus game.

In some embodiments, the processor is further configured to modify at least some of the graphical game components displayed on the first display unit.

In some embodiments, modifying at least some graphical game components displayed on the first display unit comprises overlaying a message over the at least some graphical game components.

In some embodiments, modifying at least some graphical game components displayed on the first display unit comprises altering a duration of a timeout timer.

In accordance with a further broad aspect, there is provided a method for execution by an electronic gaming machine. The method comprises storing, in at least one data storage unit, game data for a game played by a player and comprising wagering and payout elements; displaying on a display unit, via a graphical user interface, graphical game components in accordance with the game data; capturing, via at least one data capture unit, player gaze data representative of a gaze of the player, the data capture device comprising a camera; and using at least one processor. The at least one processor is used for processing the player gaze data to determine whether at least one player gaze condition is satisfied; if at least one player gaze condition is satisfied, determining whether at least one game condition is satisfied; and if at least one game condition is satisfied, modifying at least some of the graphical game components on the display unit based on the at least one satisfied game condition and at least one satisfied player gaze condition.

In some embodiments, modifying the at least some of the graphical game components on the display unit comprises overlaying a help screen over at least part of the at least some graphical game components.

In some embodiments, the player gaze condition is satisfied by the player staring at the screen for an predetermined period of time, and modifying the at least some graphical game components on the display unit comprises displaying attention-drawing graphical game components.

In some embodiments, the at least one game condition comprises the player having credit remaining in the electronic gaming device.

In some embodiments, modifying at least some graphical game components on the display unit comprises altering a duration of a timeout timer.

In some embodiments, the player gaze condition is satisfied by the player staring at the screen for an predetermined period of time, and modifying at least some graphical game components on the display unit comprises displaying a message on the display unit.

In some embodiments, the message is a responsible gaming message.

In some embodiments, the message is an advertisement.

In accordance with a further broad aspect, there is provided a method for execution by an electronic gaming machine. The method comprises storing, in at least one data storage unit, game data for a game played by a player and comprising wagering and payout elements; displaying on a display unit, via a graphical user interface, graphical game components in accordance with the game data; capturing, via at least one data capture unit, player gaze data representative of a gaze of the player, the data capture device comprising a camera; and using at least one processor. The at least one processor is used for processing the player gaze data to determine whether the player is looking at a particular graphical game component displayed on the first display unit; if the player is looking at the particular graphical game component, determining whether at least one game condition is satisfied; if at least one game condition is satisfied, displaying at least one further graphical game component on the second display unit, the at least one further graphical game component selected based on the at least one satisfied game condition.

In some embodiments, the particular graphical game component is a bonus game indicator, and the at least one further graphical game component is a bonus game.

In some embodiments, the processor is further used for modifying at least some of the graphical game components displayed on the first display unit.

In some embodiments, modifying at least some graphical game components displayed on the first display unit comprises overlaying a message over the at least some graphical game components.

In some embodiments, modifying at least some graphical game components displayed on the first display unit comprises altering a duration of a timeout timer.

In accordance with certain embodiments, there is provided a computer readable medium having stored thereon program code executable by at least one processor for performing any one or more of the methods described herein.

Features of the systems, devices, and methods described herein may be used in various combinations, and may also be used for the system and computer-readable storage medium in various combinations.

In this specification, the term "game component" or game element is intended to mean any individual element which when grouped with other elements will form a layout for a game. For example, in card games such as poker, blackjack, and gin rummy, the game components may be the cards that form the player's hand and/or the dealer's hand, and cards that are drawn to further advance the game. As a further example, in navigational games the game components may be moving or stationary objects to avoid or hit to achieve different game goals. In a maze game, the game components may be walls of the maze, objects within the maze, features of the maze, and so on. In a traditional Bingo game, the game components may be the numbers printed on a 5×5 matrix which the players must match against drawn numbers. The drawn numbers may also be game components. In a spinning reel game, each reel may be made up of one or more game components. Each game component may be represented by a symbol of a given image, number, shape, color, theme, etc. Like symbols are of a same image, number, shape, color, theme, etc. Other embodiments for game components will be readily understood by those skilled in the art.

BRIEF DESCRIPTION OF THE DRAWINGS

Further features and advantages of embodiments described herein may become apparent from the following detailed description, taken in combination with the appended drawings, in which.

It will be noted that throughout the appended drawings, like features are identified by like reference numerals.

DETAILED DESCRIPTION

Figure 1:
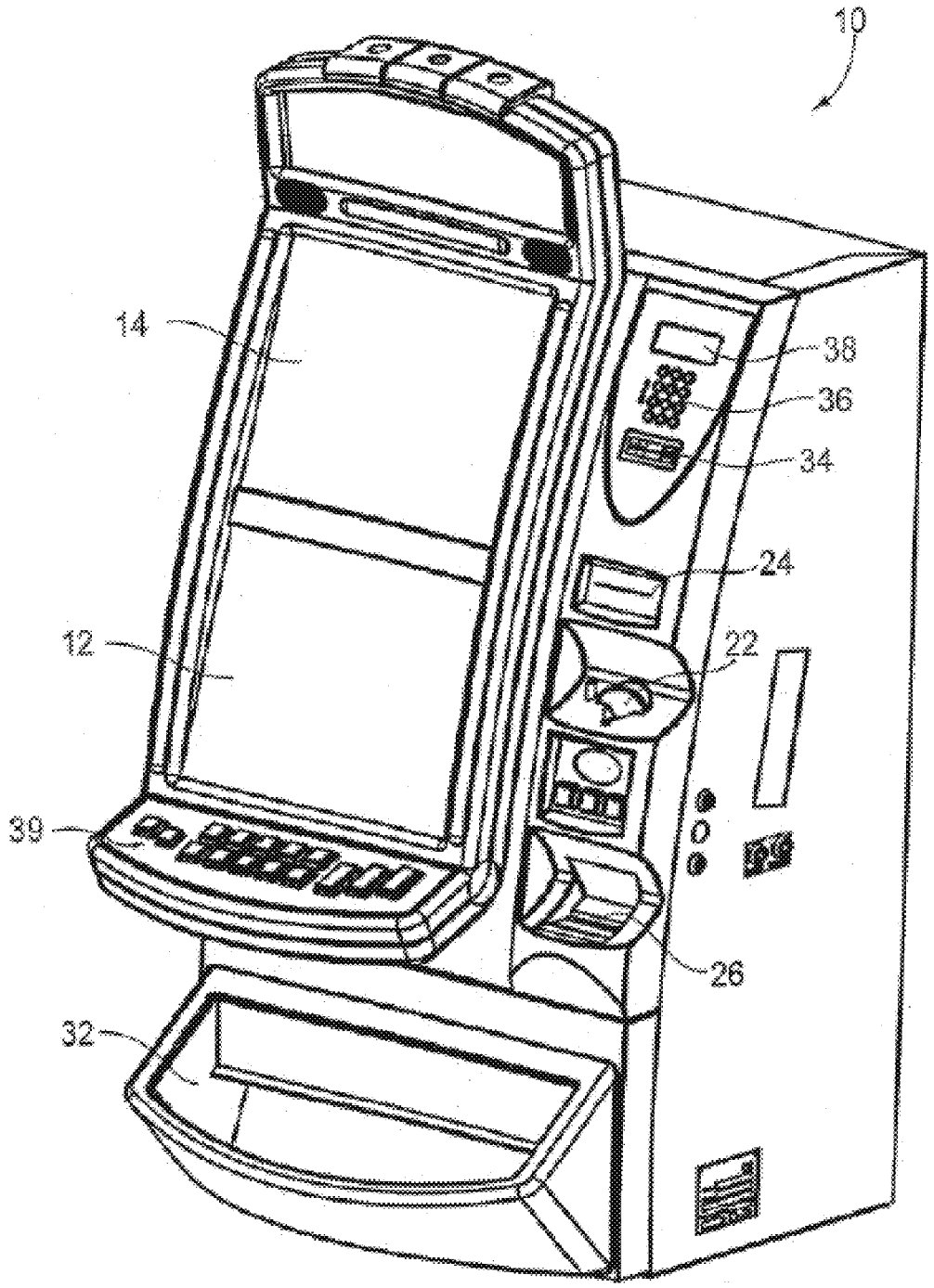
FIG. 1 is a perspective view of an electronic gaming machine for implementing the gaming enhancements, in accordance with one embodiment.

The embodiments of the systems and methods described herein may be implemented in hardware or software, or a combination of both. These embodiments may be implemented in computer programs executing on programmable computers, each computer including at least one processor, a data storage system (including volatile memory or non-volatile memory or other data storage elements or a combination thereof), and at least one communication interface. For example, and without limitation, the various programmable computers may be a server, gaming machine, network appliance, set-top box, embedded device, computer expansion module, personal computer, laptop, personal data assistant, cellular telephone, smartphone device, UMPC tablets and wireless hypermedia device or any other computing device capable of being configured to carry out the methods described herein.

Program code is applied to input data to perform the functions described herein and to generate output information. The output information is applied to one or more output devices, in known fashion. In some embodiments, the communication interface may be a network communication interface. In embodiments in which elements of the invention are combined, the communication interface may be a software communication interface, such as those for inter-process communication. In still other embodiments, there may be a combination of communication interfaces implemented as hardware, software, and combination thereof.

Each program may be implemented in a high level procedural or object oriented programming or scripting language, or a combination thereof, to communicate with a computer system. However, alternatively the programs may be implemented in assembly or machine language, if desired. The language may be a compiled or interpreted language. Each such computer program may be stored on a storage media or a device (e.g., ROM, magnetic disk, optical disc), readable by a general or special purpose programmable computer, for configuring and operating the computer when the storage media or device is read by the computer to perform the procedures described herein. Embodiments of the system may also be considered to be implemented as a non-transitory computer-readable storage medium, configured with a computer program, where the storage medium so configured causes a computer to operate in a specific and predefined manner to perform the functions described herein.

Furthermore, the systems and methods of the described embodiments are capable of being distributed in a computer program product including a physical, non-transitory computer readable medium that bears computer usable instructions for one or more processors. The medium may be provided in various forms, including one or more diskettes, compact disks, tapes, chips, magnetic and electronic storage media, volatile memory, non-volatile memory and the like. Non-transitory computer-readable media may include all computer-readable media, with the exception being a transitory, propagating signal. The term non-transitory is not intended to exclude computer readable media such as primary memory, volatile memory, RAM and so on, where the data stored thereon may only be temporarily stored. The computer useable instructions may also be in various forms, including compiled and non-compiled code.

Throughout the following discussion, numerous references will be made regarding servers, services, interfaces, portals, platforms, or other systems formed from computing devices. It should be appreciated that the use of such terms is deemed to represent one or more computing devices having at least one processor configured to execute software instructions stored on a computer readable tangible, non-transitory medium. For example, a server can include one or more computers operating as a web server, database server, or other type of computer server in a manner to fulfill described roles, responsibilities, or functions. One should further appreciate the disclosed computer-based algorithms, processes, methods, or other types of instruction sets can be embodied as a computer program product comprising a non-transitory, tangible computer readable media storing the instructions that cause a processor to execute the disclosed steps. One should appreciate that the systems and methods described herein may transform electronic signals of various data objects into graphical representations for display on a tangible screen configured for displaying graphical game components. One should appreciate that the systems and methods described herein involve interconnected networks of hardware devices configured to receive data for tracking player movements using receivers and sensors, transmit player movement data using transmitters, and transform electronic data signals for various graphical enhancements using particularly configured processors to modify the display of the graphical enhancements on adapted display screens in response to the tracked player movements. That is, tracked player movements may result in manipulation and movement of various graphical features of a game.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

The gaming enhancements described herein may be carried out using any type of computer, including portable devices, such as smart phones, that can access a gaming site or a portal (which may access a plurality of gaming sites) via the internet or other communication path (e.g., a LAN or WAN). Embodiments described herein can also be carried out using an electronic gaming machine (EGM) in various venues, such as a casino. One example type of EGM is described with respect to FIG. 1.

FIG. 1 is a perspective view of an EGM 10 where the graphical enhancements to game components may be provided. EGM 10 includes a display unit 12 that may be a thin film transistor (TFT) display, a liquid crystal display (LCD), a cathode ray tube (CRT), auto stereoscopic three-dimensional display and LED display, an OLED display, or any other type of display. A secondary display unit 14 provides game data or other information in addition to display unit 12. Secondary display unit 14 may provide static information, such as an advertisement for the game, the rules of the game, pay tables, pay lines, or other information, or may even display the main game or a bonus game along with display unit 12. Alternatively, the area for secondary display unit 14 may be a display glass for conveying information about the game. Display unit 12 and/or secondary display unit 14 may also include a camera.

Display unit 12 or 14 may have a touch screen lamination that includes a transparent grid of conductors. Touching the screen may change the capacitance between the conductors, and thereby the X-Y location of the touch may be determined. The processor associates this X-Y location with a function to be performed. Such touch screens may be used for slot machines. There may be an upper and lower multi-touch screen in accordance with some embodiments.

A coin slot 22 may accept coins or tokens in one or more denominations to generate credits within EGM 10 for playing games. An input slot 24 for an optical reader and printer receives machine readable printed tickets and outputs printed tickets for use in cashless gaming.

A coin tray 32 may receive coins or tokens from a hopper upon a win or upon the player cashing out. However, the gaming machine 10 may be a gaming terminal that does not pay in cash but only issues a printed ticket for cashing in elsewhere. Alternatively, a stored value card may be loaded with credits based on a win, or may enable the assignment of credits to an account associated with a computer system, which may be a computer network connected computer.

A card reader slot 34 may accept various types of cards, such as smart cards, magnetic strip cards, or other types of cards conveying machine readable information. The card reader reads the inserted card for player and credit information for cashless gaming. The card reader may read a magnetic code on a conventional player tracking card, where the code uniquely identifies the player to the host system. The code is cross-referenced by the host system to any data related to the player, and such data may affect the games offered to the player by the gaming terminal. The card reader may also include an optical reader and printer for reading and printing coded barcodes and other information on a paper ticket. A card may also include credentials that enable the host system to access one or more accounts associated with a player. The account may be debited based on wagers by a player and credited based on a win. Alternatively, an electronic device may couple (wired or wireless) to the EGM 10 to transfer electronic data signals for player credits and the like. For example, near field communication (NFC) may be used to couple to EGM 10 which may be configured with NFC enabled hardware. This is a non-limiting example of a communication technique.

A keypad 36 may accept player input, such as a personal identification number (PIN) or any other player information. A display 38 above keypad 36 displays a menu for instructions and other information and provides visual feedback of the keys pressed.

The keypad 36 may be an input device such as a touch-screen, or dynamic digital button panel, in accordance with some embodiments.

Player control buttons 39 may include any buttons or other controllers needed for the play of the particular game or games offered by EGM 10 including, for example, a bet button, a repeat bet button, a spin reels (or play) button, a maximum bet button, a cash-out button, a display pay lines button, a display payout tables button, select icon buttons, and any other suitable button. Buttons 39 may be replaced by a touch screen with virtual buttons.

The EGM 10 may also include hardware configured to provide motion tracking. An example type of motion tracking is optical motion tracking. The motion tracking may include a body and head controller. The motion tracking may also include an eye controller. The EGM 10 may implement eye-tracking recognition technology using a camera, sensors (e.g. optical sensor), data receivers and other electronic hardware. Players may move side to side to control the game and game components. For example, the EGM 10 is configured to track player's eyes, so when the eyes move left, right, up or down, a character or symbol on screen moves in response to the player's eye movements. In a navigational game, the player may have to avoid obstacles, or possibly catch items to collect. The virtual movements may be based on the tracking recognition data.

The EGM 10 may include a camera. The camera may be used for motion tracking of player, such as detecting player positions and movements, and generating signals defining x, y and z coordinates. For example, the camera may be used to implement tracking recognition techniques to collect tracking recognition data. As an example, the tracking data may relate to player eye movements. The eye movements may be used to control various aspects of a game or a game component. The camera may be configured to track the precise location of a player's left and/or right eyeballs in real-time or near real-time as to interpret and record the player's eye movement data. The eye movement data may be one way of defining player movements.

For example, the recognition data defining player movement may be used to manipulate or move game components. As another example, the recognition data defining player movement may be used to change a view of the gaming surface or gaming component. A viewing object of the game may be illustrated as a graphical enhancement coming towards the player. Another viewing object of the game may be illustrated as a graphical enhancement moving away from the player. The players head position may be used as a view guide for the viewing camera during a graphical enhancement. A player sitting directly in front of display unit 12 may see a different view than a player moving aside. The camera may also be used to detect occupancy of the machine.

The embodiments described herein are implemented by physical computer hardware embodiments. The embodiments described herein provide useful physical machines and particularly configured computer hardware arrangements of computing devices, servers, electronic gaming terminals, processors, memory, networks, for example. The embodiments described herein, for example, is directed to computer apparatuses, and methods implemented by computers through the processing of electronic data signals.

Accordingly, EGM 10 is particularly configured for moving game components. The display unit 12 and/or the secondary display unit 14 may display via a user interface graphical game components of a game in accordance with a set of game rules using game data, stored in a data storage device.

At least one data capture unit collects player movement data, where the player movement data defines movement of a player of the game. The data capture unit may include a camera, a sensor or other data capture electronic hardware. The EGM 10 may include at least one processor configured to transform the player movement data into data defining game movement for the at least one game component, and generate movement on the display device of the at least one game component using the data defining game movement.

The embodiments described herein involve computing devices, servers, electronic gaming terminals, receivers, transmitters, processors, memory, display, networks particularly configured to implement various acts. The embodiments described herein are directed to electronic machines adapted for processing and transforming electromagnetic signals which represent various types of information. The embodiments described herein pervasively and integrally relate to machines, and their uses; and the embodiments described herein have no meaning or practical applicability outside their use with computer hardware, machines, a various hardware components.

Substituting the computing devices, servers, electronic gaming terminals, receivers, transmitters, processors, memory, display, networks particularly configured to implement various acts for non-physical hardware, using mental steps for example, may substantially affect the way the embodiments work.

Such computer hardware limitations are clearly essential elements of the embodiments described herein, and they cannot be omitted or substituted for mental means without having a material effect on the operation and structure of the embodiments described herein. The computer hardware is essential to the embodiments described herein and is not merely used to perform steps expeditiously and in an efficient manner.

As described herein, EGM 10 may be configured to provide graphical enhancements to game components. The graphical enhancements may be provided dynamically as dynamic game content in response to electronic data signals relating to tracking recognition data collected by EGM 10.

The EGM 10 may include a display with multi-touch and auto stereoscopic three-dimensional functionality, including a camera, for example. The EGM 10 may also include several effects and frame lights. The graphical enhancements may be graphical variants of gaming components. For example, the graphical variants may not be limited to a three-dimensional version of the gaming components.

EGM 10 may include an output device such as one or more speakers. The speakers may be located in various locations on the EGM 10 such as in a lower portion or upper portion. The EGM 10 may have a chair or seat portion and the speakers may be included in the seat portion to create a surround sound effect for the player. The seat portion may allow for easy upper body and head movement during play. Functions may be controllable via an on screen game menu. The EGM 10 is configurable to provide full control over all built-in functionality (lights, frame lights, sounds, and so on).

The EGM 10 may also include a digital button panel. The digital button panel may include various elements such as a touch display, animated buttons, a frame light, and so on. The digital button panel may have different states, such as for example, standard play containing bet steps, bonus with feature layouts, point of sale, and so on. The digital button panel may include a slider bar for adjusting the three-dimensional panel. The digital button panel may include buttons for adjusting sounds and effects. The digital button panel may include buttons for betting and selecting bonus games. The digital button panel may include a game status display. The digital button panel may include animation. The buttons of the digital button panel may include a number of different states, such as pressable but not activated, pressed and active, inactive (not pressable), certain response or information animation, and so on. The EGM 10 may also include physical buttons.

The EGM 10 may include frame and effect lights. The lights may be synchronized with enhancements of the game. The EGM 10 may be configured to control color and brightness of lights. Additional custom animations (color cycle, blinking, etc.) may also be configured by the EGM 10. The customer animations may be triggered by certain gaming events.

Figure 2A:
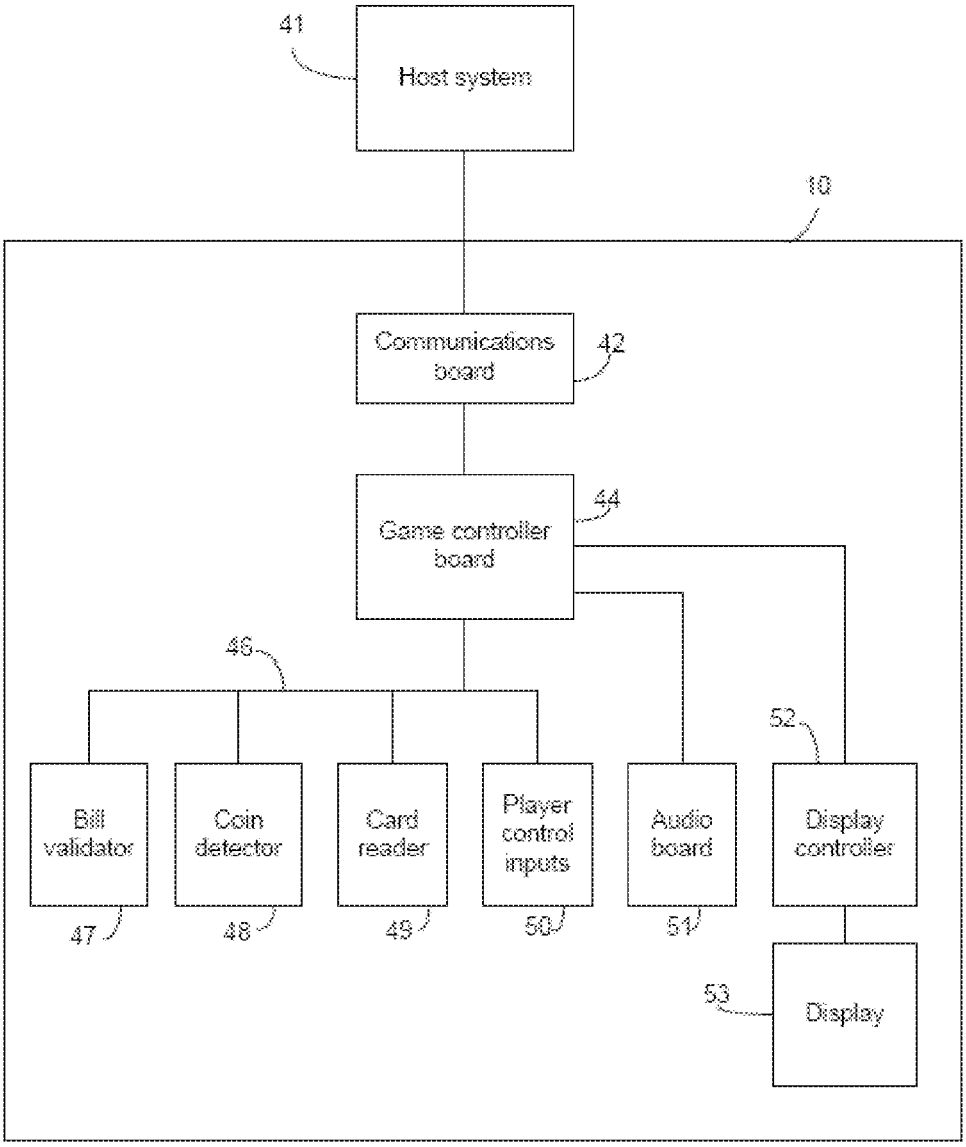
FIG. 2A is a block diagram of an electronic gaming machine linked to a casino host system, in accordance with one embodiment.
Figure 2B:
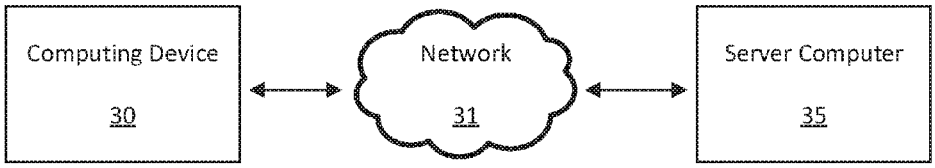
FIG. 2B is an exemplary online implementation of a computer system and online gaming system.

FIG. 2A is a block diagram of EGM 10 linked to the casino's host system 41. The EGM 10 may use conventional hardware. FIG. 2B illustrates a possible online implementation of a computer system and online gaming device in accordance with the present gaming enhancements. For example, a server computer 35 may be configured to enable online gaming in accordance with embodiments described herein. One or more players may use a computing device 30 (which may be the EGM 10) that is configured to connect to a network 31, such as the Internet (or other network), and via the network 31 to the server computer 35 in order to access the functionality described in this disclosure. The server computer 35 may include a movement recognition engine that may be used to process and interpret collected player movement data, to transform the data into data defining manipulations of game components or view changes.

A communications board 42 may contain conventional circuitry for coupling the EGM 10 to a local area network (LAN) or other type of network using any suitable protocol, such as the G2S protocols. Internet protocols are typically used for such communication under the G2S standard, incorporated herein by reference. The communications board 42 transmits using a wireless transmitter, or it may be directly connected to a network running throughout the casino floor. The communications board 42 basically sets up a communication link with a master controller and buffers data between the network and the game controller board 44. The communications board 42 may also communicate with a network server, such as in accordance with the G2S standard, for exchanging information to carry out embodiments described herein.

The game controller board 44 contains memory and a processor for carrying out programs stored in the memory and for providing the information requested by the network. The game controller board 44 primarily carries out the game routines.

Peripheral devices/boards communicate with the game controller board 44 via a bus 46 using, for example, an RS-232 interface. Such peripherals may include a bill validator 47, a coin detector 48, a smart card reader or other type of credit card reader 49, and player control inputs 50 (such as buttons or a touch screen). Other peripherals may be one or more cameras used for collecting eye-tracking recognition data, or other player movement recognition data.

The game controller board 44 may also control one or more devices that produce the game output including audio and video output associated with a particular game that is presented to the player. For example audio board 51 may convert coded signals into analog signals for driving speakers. A display controller 52, which typically requires a high data transfer rate, may convert coded signals to pixel signals for the display 53. Display controller 52 and audio board 51 may be directly connected to parallel ports on the game controller board 44. The electronics on the various boards may be combined onto a single board.

Computing device 30 may be particularly configured with hardware and software to interact with gaming machine 10 or server computer 35 via network 31 to implement gaming functionality and render graphical enhancements, as described herein. For simplicity only one computing device 30 is shown but system may include one or more computing devices 30 operable by players to access remote network resources. Computing device 30 may be implemented using one or more processors and one or more data storage devices configured with database(s) or file system(s), or using multiple devices or groups of storage devices distributed over a wide geographic area and connected via a network (which may be referred to as "cloud computing").

Computing device 30 may reside on any networked computing device, such as a personal computer, workstation, server, portable computer, mobile device, personal digital assistant, laptop, tablet, smart phone, WAP phone, an interactive television, video display terminals, gaming consoles, electronic reading device, portable electronic devices, wearable electronic device, or any suitable combination of these.

Computing device 30 may include any type of processor, such as, for example, any type of general-purpose microprocessor or microcontroller, a digital signal processing (DSP) processor, an integrated circuit, a field programmable gate array (FPGA), a reconfigurable processor, a programmable read-only memory (PROM), or any combination thereof. Computing device 30 may include any type of computer memory that is located either internally or externally such as, for example, random-access memory (RAM), read-only memory (ROM), compact disc read-only memory (CDROM), electro-optical memory, magneto-optical memory, erasable programmable read-only memory (EPROM), and electrically-erasable programmable read-only memory (EEPROM), Ferroelectric RAM (FRAM) or the like.

Computing device 30 may include one or more input devices, such as a keyboard, mouse, camera, touch screen and a microphone, and may also include one or more output devices such as a display screen (with three-dimensional capabilities) and a speaker. Computing device 30 has a network interface in order to communicate with other components, to access and connect to network resources, to serve an application and other applications, and perform other computing applications by connecting to a network (or multiple networks) capable of carrying data including the Internet, Ethernet, plain old telephone service (POTS) line, public switch telephone network (PSTN), integrated services digital network (ISDN), digital subscriber line (DSL), coaxial cable, fiber optics, satellite, mobile, wireless (e.g. Wi-Fi, WiMAX), SS7 signaling network, fixed line, local area network, wide area network, and others, including any combination of these. Computing device 30 is operable to register and authenticate players (using a login, unique identifier, and password for example) prior to providing access to applications, a local network, network resources, or other networks and network security devices. Computing device 30 may serve one player or multiple players.

While the following paragraphs refer to the EGM 10, it should be understood that the embodiments described herein may be implemented on the computing device 30, which may take a plurality of different forms including, as mentioned supra, mobile devices such as smartphones, and other portable or wearable electronic devices.

Figure 3:
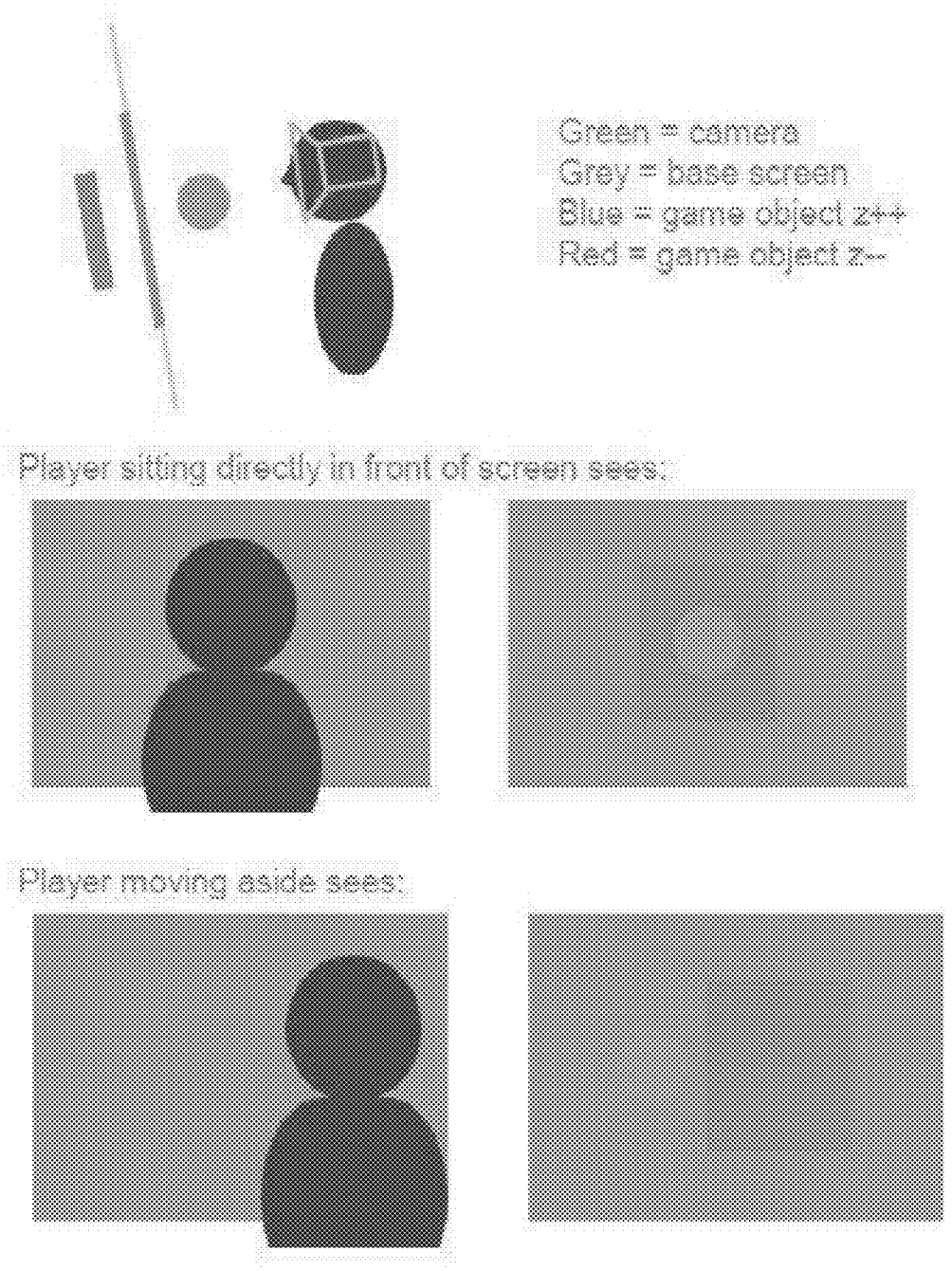
FIG. 3 illustrates an electronic gaming machine with a camera for implementing the gaming enhancements, in accordance with some embodiments.

FIG. 3 illustrates an electronic gaming machine with a camera 15 for implementing the gaming enhancements, in accordance with some embodiments. The EGM 10 may include the camera 15, sensors (e.g. optical sensor), or other hardware device configured to capture and collect data relating to player movement.

In accordance with some embodiments, the camera 15 may be used for motion tracking, and movement recognition. The camera 15 may collect data defining x, y and z coordinates representing player movement.

In some examples, a viewing object of the game (shown as a circle in front of the base screen) may be illustrated as a graphical enhancement coming towards the player. Another viewing object of the game (shown as a rectangle behind the base screen) may be illustrated as a graphical enhancement moving away from the player. The players head position may be used as a view guide for the viewing camera during a graphical enhancement. A player sitting directly in front of display unit 12 may see a different view than a player moving aside. The camera 15 may also be used to detect occupancy of the machine. The camera 15 and/or a sensor (e.g. an optical sensor) may also be configured to detect and track the position(s) of a player's eyes or more precisely, pupils, relative to the screen of the EGM 10.

The camera 15 may also be used to collect data defining player eye movement, gestures, head movement, or other body movement. Players may move side to side to control the game. The camera 15 may collect data defining player movement, process and transform the data into data defining game manipulations (e.g. movement for game components), and generate the game manipulations using the data. For example, player's eyes may be tracked by camera 15 (or another hardware component of EGM 10), so when the eyes move left, right, up or down, their character or symbol on screen moves in response to the player's eye movements. The player may have to avoid obstacles, or possibly catch or contact items to collect depending on the type of game. These movements within the game may be directed based on the data derived from collected movement data.

In one embodiment of the invention, the camera 15 is coupled with an optical sensor to track a position of a player's each eye relative to a center of a EGM 10's screen, as well as a focus direction and a focus point on the EGM 10's screen of the player's both eyes in real-time or near real-time. The focus direction can be the direction at which the player's line of sight travels or extends from his or her eyes to the EGM 10's screen. The focus point may sometimes be referred to as a gaze point and the focus direction may sometimes be referred to as a gaze direction. In one example, the focus direction and focus point can be determined based on various eye tracking data such as position(s) of a player's eyes, a position of his or her head, position(s) and size(s) of the pupils, corneal reflection data, and/or size(s) of the irises. All of the above mentioned eye tracking or movement data, as well as the focus direction and focus point, may be examples of, and referred to as, player's eye movements or player movement data.

Figure 4:
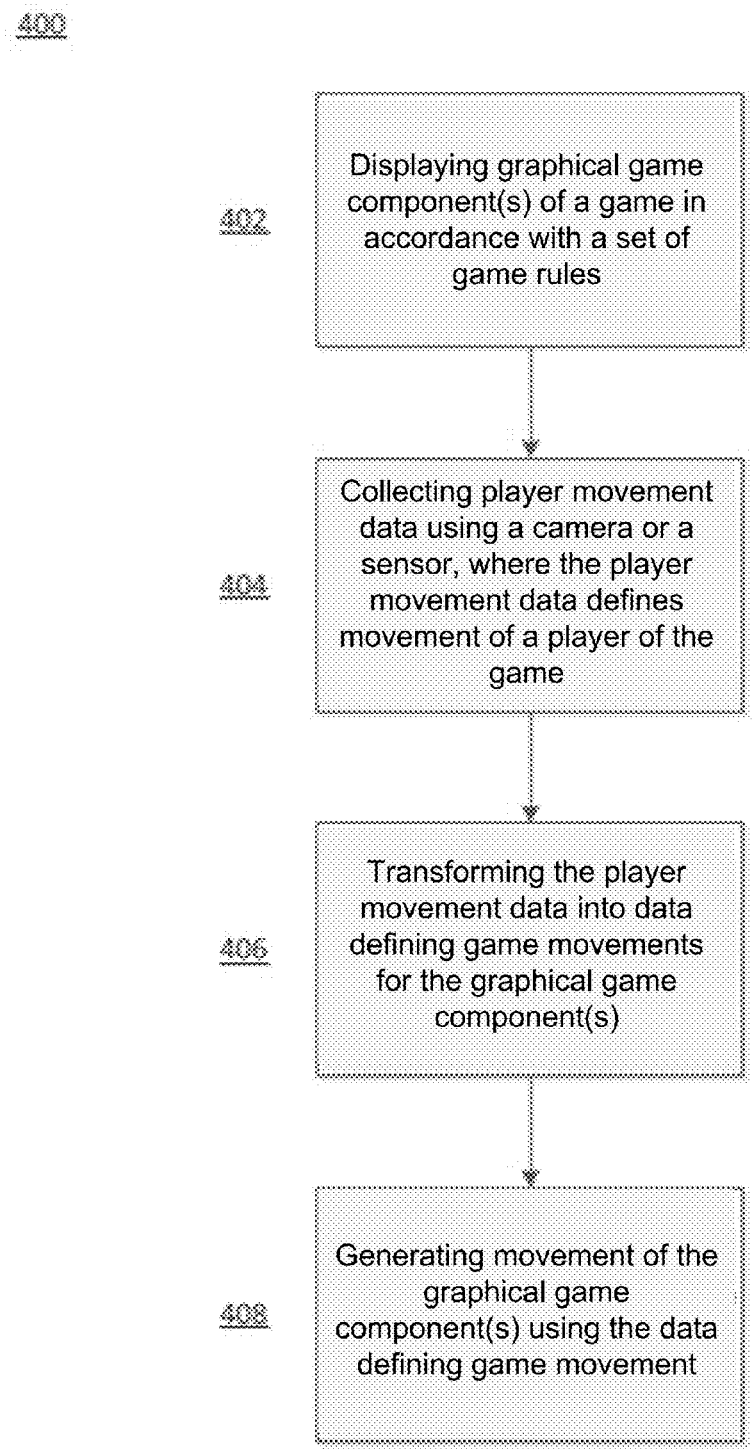
FIG. 4 illustrates a flowchart diagram of an exemplary computer-implemented method for the game component enhancements.

Referring now to FIG. 4, there is shown a flowchart diagram of an exemplary computer-implemented method 400 for moving game component in a gaming system such as that illustrated in FIGS. 1, 2A, and 2B.

At 402, the EGM 10 displays on a display device, such as display unit 12 and/or secondary display unit 14, a user interface showing one or more graphical game components of a game in accordance with a set of game rules for the game. The game component may be a virtual character, a gaming symbol, a stack of game components along an axis orthogonal to a plane of the display device, a multi-faceted game component, a reel, a grid, a multi-faceted gaming surface, and gaming surface, or a combination thereof.

A game component may be selected to move or manipulate with the player's eye movements. The gaming component may be selected by the player or by the game. For example, the game outcome or state may determine which symbol to select for enhancement.

At 404, a data capture unit collects player movement data, where the player movement data defines movement of the player. The data capture unit may be a camera, a sensor, and/or other hardware device configured to capture and collect data relating to player movement. The data capture unit may integrally connect to EGM 10 or may be otherwise coupled thereto.

As previously described, the camera 15 may be coupled with an optical sensor to track a position of a player's each eye relative to a center of a EGM 10's screen, as well as a focus direction and a focus point on the EGM 10's screen of the player's both eyes in real-time or near real-time. The focus direction can be the direction at which the player's line of sight travels or extends from his or her eyes to the EGM 10's screen. The focus point may sometimes be referred to as a gaze point and the focus direction may sometimes be referred to as a gaze direction. In one example, the focus direction and focus point can be determined based on various eye tracking data such as position(s) of a player's eyes, a position of his or her head, position(s) and size(s) of the pupils, corneal reflection data, and/or size(s) of the irises. All of the above mentioned eye tracking or movement data, as well as the focus direction and focus point, may be instances of player movement data.

In addition, a focus point may extend to or encompass different visual fields visible to the player. For example, a foveal area may be a small area surrounding a fixation point on the EGM 10's screen directly connected by a (virtual) line of sight extending from the eyes of a player. This foveal area in the player's vision generally appears to be in sharp focus and may include one or more game components and the surrounding area. In this disclosure, it is understood that a focus point may include the foveal area immediately adjacent to the fixation point directly connected by the (virtual) line of sight extending from the player's eyes.

The player movement data may relate to the movement of the player's eyes. For example, the player's eyes may move or look to the left which may trigger a corresponding movement of a game component within the game. The movement of the player's eyes may also trigger an updated view of the entire game on display to reflect the orientation of the player in relation to the display device. The player movement data may also be associated with movement of the player's head, or other part of the player's body. As a further example, the player movement data may be associated with a gesture made by the player, such as a particular hand or finger signal.

At 406, a processor of EGM 10 (e.g. coupled thereto or part thereof) may transform the player movement data into data defining game movement for the game component(s).

At 408, the processor generates movement of the game component(s) using the data defining game movement. The display device updates to visually display the movement of the game component(s) for the player. The movement may be a rotation about an axis, or directional movement (e.g. left, right, up, down), or a combination thereof. The movement may also be an update a view of the game on the display using the data defining game movement.

Accordingly, the EGM 10 is configured to monitor and track player movement including eye movement data, and in response generate corresponding movements of the game component(s). The EGM 10 (e.g. processor) may be programmed with control logic to map different player movements to different movements of the game component(s).

Figure 5:
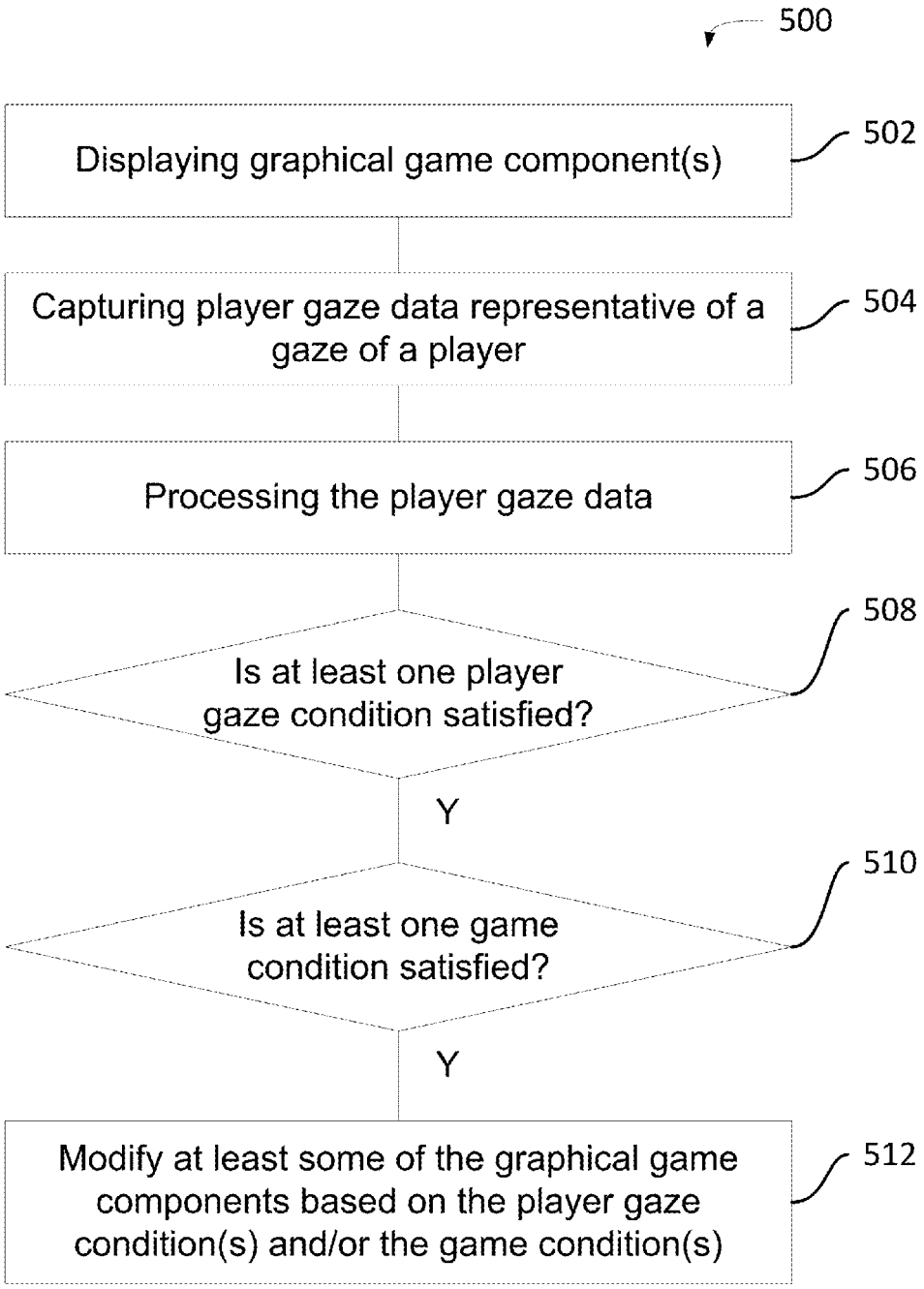
FIG. 5 illustrates a flowchart diagram of an exemplary computer-implemented method for the game component enhancements.

With reference to FIG. 5, there is provided an exemplary computer-implemented method 500 for presenting graphical game components to a player of the EGM 10, which is illustrated as a flowchart. The method may be implemented, for example, by the EGM 10. The graphical game components presented may be any suitable graphical game components, such as messages (textual or otherwise), avatars, images, icons, animations, backgrounds, skyboxes, and the like, and may be presented in 2D or in 3D. Additionally, the graphical game components may be static, or may be animated in any suitable fashion.

In step 502, the EGM 10 displays at least one graphical game component to the player. The graphical game component may be displayed on the display unit 12, on the display unit 14, or on any suitable combination thereof, including being displayed across the display units 12, 14, being alternatingly displayed on the display units 12, 14, and the like. The graphical game component may be displayed for example, as a result of an interaction between the player and the EGM 10, processes internal to the EGM 10, at least one timer, or at least one external trigger, which may be based on information collected by the EGM 10 about the external environment, such as by the camera, or due to any other suitable trigger.

In step 504, the EGM 10 captures player gaze data representative of a gaze of the player. Player gaze data may be collected via the camera, or via any other suitable sensor mentioned hereinabove. Player gaze data may be representative of position, orientation, and/or movement of at least one eye of the player, and may provide information about where a player is looking in relation to the EGM 10. This may provide specific information regarding which of the display units 12, 14 the player is looking at and where on the display units 12, 14 the player is looking; additionally, or in the alternative, the player gaze data may indicate a path covered by the gaze of the player across the display units 12, 14, the speed at which the path was traversed, and the like. The player gaze data may be captured in a substantially real-time stream, at periodic intervals, or based on one or more triggers internal or external to the EGM 10. In some cases, the tracking of player gaze data may be a premium feature available to only certain players: premium features may be allocated to players who play games at a certain frequency, or who spend a certain amount of money playing (on the whole or per unit time). Access to premium features may be tied to the player account.

At step 506, the player gaze data captured at step 504 is analyzed by the EGM 10, and more specifically by the game controller board 44. The analysis may be performed in any suitable fashion, including motion detection, edge detection, full-scale detection, and the like. The player gaze data may be analyzed to detect, for example, motion of the player's eyes, as described hereinabove, in three-dimensional space. In some embodiments, the player movement data may be analyzed to determine the location and orientation of the player's eye or eyes, which may include determining a location at which the player is looking, specifically a location on the display unit 12 or the secondary display unit 14 at which the player is looking, as discussed supra. Alternatively, or in addition, the player movement data may be analyzed to determine the direction and/or speed of motion of the player's eye or eyes.

In cases where the analysis of the player gaze data indicates that the player is not looking at either display unit 12 or the secondary display unit 14, the EGM 10 may be interested in the last location on the display unit 12 or the secondary display unit 14 at which the player was looking. As such, the analysis of the player movement data may be stored, temporarily or permanently, in the memory of the game controller board 44.

At step 508, the EGM 10 uses the processed player gaze data to determine if at least one player gaze condition is satisfied. Player gaze conditions may be stored—as a part of the game data—in the data storage device, and may be satisfied when certain types of gaze actions done by the player are detected at step 506. These gaze actions may be macro-level actions, such as "the player has been looking at the screen for more than 60 minutes", micro-level actions, such as "the player just altered their gaze to look at a point P on the screen", or any combination thereof, such as "the player altered their gaze to look at point P on the screen 180 seconds ago", which combines a macro-level gaze action (the amount of time the player has been looking at the graphical game component) with a micro-level gaze action (the fact that the player has altered their gaze to look at a particular area on the screen).

Player gaze conditions may relate to any manner of gaze action, including glancing, looking, or staring at a graphical game component, scanning or reading a message or other text element, alternately looking at different graphical game component, and the like. Player gaze conditions may also relate to locations at which a player is looking, the time spent looking at certain graphical game components, and may also relate to the intensity with which the player is looking at a certain graphical game component. Player gaze conditions may also be simple, i.e. requiring only one gaze action to be completed in order to be satisfied, or complex, i.e. requiring a plurality of gaze actions to be completed in succession, in a certain amount of time, concurrently, or the like, in order to be satisfied.

As described herein, the difference between glancing, looking, and staring may be determined by the length of time of the gaze action, wherein glancing may be very short (<1 second), looking may be of medium duration, and staring may be long (>5 seconds). It should be noted that the time durations mentioned here are merely examples, and that other durations may be chosen where suitable. The difference between scanning and reading may be more complex, and may be dependent on a variety of factors, including gaze duration, gaze movement, gaze movement speed, and the like, and is described in greater detail hereinafter.

If no player gaze condition is satisfied, the method 500 continues from step 504, capturing player gaze data and then processing the player gaze data at step 506, until at least one player gaze condition is satisfied. If at least one player gaze condition is found to be satisfied, the method continues to step 510.

At step 510, the EGM determines if at least one game condition is satisfied. Game conditions may be stored—as a part of the game data, in the data storage device, and may relate to any facet of the game being played by the player and/or to the at least one satisfied player gaze condition. Game conditions are discussed in greater detail hereinbelow.

If no game condition is satisfied, the method 500 continues from step 504, capturing player gaze data and then processing the player gaze data at step 506, until both at least one player gaze condition and at least one game condition are satisfied. If at least one game condition is found to be satisfied, the method continues to step 512.

At step 512, in response to both at least one player gaze condition and at least one game condition being satisfied, the EGM 10 may modify at least some of the graphical game components based on at least one of the satisfied player gaze condition(s) and the satisfied game condition(s). In some cases, these modified graphical game components may be presented on the same display unit 12, 14, on which they were originally presented; alternatively, if the original graphical game components are presented on the display unit 12, the modified graphical game components may be presented on the secondary display unit 14, and vice-versa. Moreover, modifying at least some of the graphical game components may also include creating or adding new graphical game components (i.e., causing previously-undisplayed graphical game components to be displayed) and destroying or removing existing graphical game components (i.e., causing previously-displayed graphical game components to no longer be displayed).

It should be noted that the above-presented steps may be repeated as many times as desired in response to further player gaze data being collected (and respective player gaze and game conditions being satisfied). The following paragraphs describe an exemplary embodiment thereof with reference to FIGS. 6A-B.

Figure 6A:
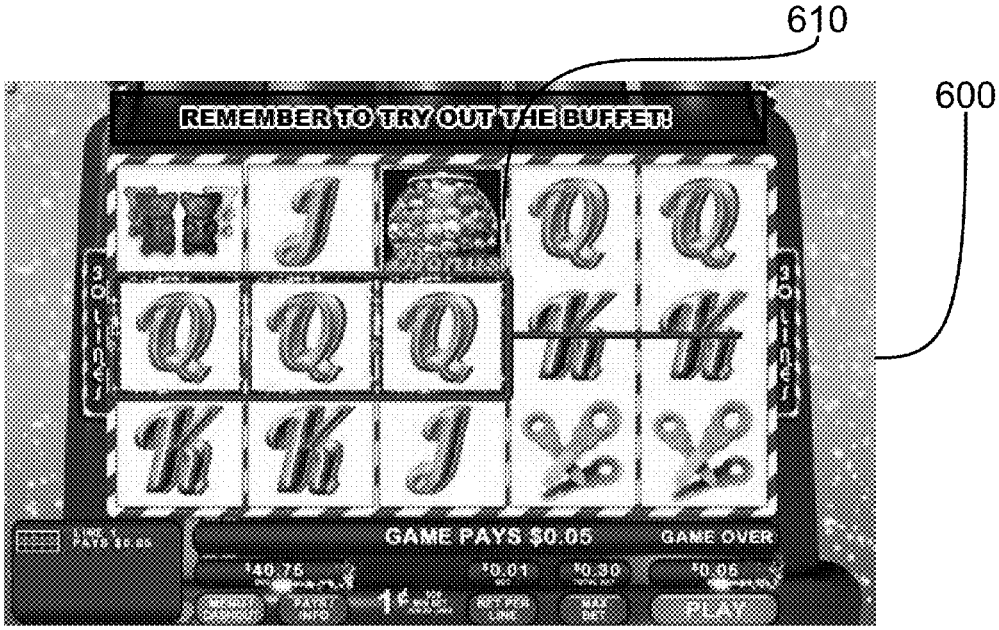
FIGS. 6A-B are illustrative screenshots of game screens of a particular implementation of the method described in FIG. 5.

With reference to FIG. 6A, a player playing a game on EGM 10 may be presented with a game screen 600 on display unit 12 where the game screen 600 comprises a plurality of graphical game components, including a bonus indicator, such as a bonus box 610. In this example, the bonus box 610 is one of a plurality of symbols appearing on reels of a virtual slot machine—it should be noted that variations to both the type of game and the particular graphical game components may be considered.

The bonus box 610 may allow the player to access a bonus game mode: in this particular example, the bonus activates when the bonus box 610 appears in the middle reel, as is shown in FIG. 6A, and is played on the secondary display unit 14. In order to begin the bonus game mode, the player may look at secondary display unit 14 when the bonus box 610 appears in the middle reel.

In this particular example, the player may not be aware of the significance of the bonus box 610, and additionally may not be aware of the existence of the bonus game mode. This may cause the player to stare at the bonus box 610 for an extended period of time—as discussed supra, the length of time the player gazes at the bonus box 610 in order for the gaze action to be considered staring may vary, but generally the player may gaze at the bonus box 610 for an extended period of time.

The EGM 10 may be collecting player gaze data during this time, and may, based on an analysis of the player gaze data, determine that the player has been staring at a particular point on the display unit 12 for an extended period of time. This gaze action by the player may satisfy at least one player gaze condition. If so, the EGM 10 may then determine if at least one game condition is satisfied: in this case, the game condition may be that a particular graphical game component is being displayed at the point on the display unit 12 where the player is staring. In this example, the EGM 10 may determine that the point on the display unit 12 where the player is staring is currently displaying the bonus box 610. This may indicate to the EGM 10 that the player is confused by the bonus box 610.

Figure 6B:
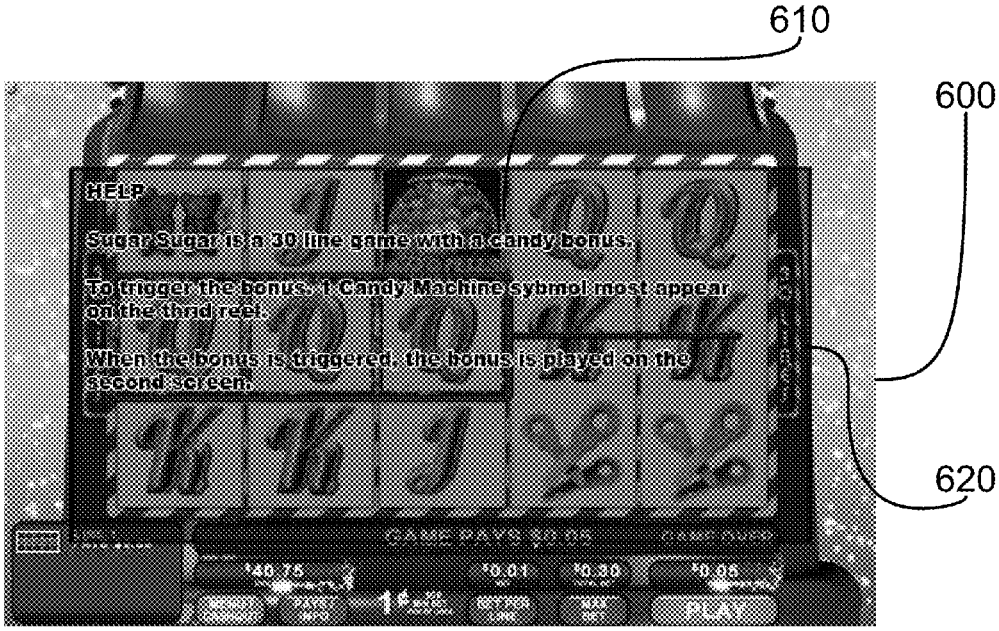

With reference to FIG. 6B, in response to the player gaze condition and the game condition being satisfied, the EGM 10 may modify at least some of the graphical game components. In this case, the player being confused by the bonus box 610 causes the EGM 10 to cause additional graphical game components to be displayed, namely help screen 620, which is overlaid on the existing graphical game components of the game screen 600, including the bonus box 610. In this embodiment, help screen 620 presents information to the player regarding the bonus box 610, since the player was confused by the bonus box 610. In the event that the player indicates confusion about a different graphical game component, the help screen 620 may present game information relevant to the different graphical game components.

While in this embodiment, the combination of the satisfied player gaze condition and game condition is understood by the EGM 10 to mean that the player is confused by the bonus box 610, in other embodiments, the EGM 10 may draw different inferences. For example, in some embodiments the bonus game mode may be triggered by the player staring at the bonus box for a predetermined amount of time. Once this player gaze condition is satisfied (and the bonus box 610 is present at the appropriate location), the bonus game mode may begin. However, if the player continues staring at the bonus box 610, this may in fact signal that the player is confused by the bonus box 610, and the above-mentioned example may be executed.

The EGM 10 may use the player gaze data, in association with game conditions being satisfied, to make other inferences about the player. For example, if the player gaze data is indicative of the player staring at a certain point of one of the display units 12, 14, for an extended period of time and the player has credit(s) remaining in the EGM 10, the EGM 10 may present flashing or otherwise attention-drawing graphical game components at the point where the player is staring in an attempt to capture the player's attention and get them to play the game. Similarly, if the player has been staring at a certain point on one of the display units 12, 14, for an extended period of time and the player has no credit remaining in the EGM 10, the EGM 10 may present flashing or otherwise attention-drawing graphical game components at the point where the player is staring to entice them to acquire more credits.

The EGM 10 may also display prompts to the user—these may be textual or image-based, and may include public-service announcements, advertisements, and the like. In some cases, these prompts may have a built-in timeout feature: that is to say, the prompts may be displayed on the screen for only a given length of time (10 seconds, 15 seconds, or any other suitable duration) before disappearing. In the event that the EGM 10 determines from player gaze data that the player is still looking at a prompt with a timeout feature, the EGM 10 may decide to lengthen the duration of the timeout. The timeout duration may be lengthened until the player looks away from the timeout, until the player looks away plus some buffer time, or may simply add seconds to the timeout duration every time the player looks back at the prompt. Other ways of adjusting prompt timeouts are also considered.

In cases where the prompts are advertisements, the EGM 10 may be configured for determining when player gaze data indicates that a player has looked at an advertisement prompt. The EGM 10 may also determine the amount of time the player spends looking at the advertisement prompt, as well as any other suitable marketing analytics data. In return for looking at advertisements, the player may be awarded additional credit(s) and/or free plays, which may vary based on any one or more marketing analytics, including number of advertisements viewed, time spent viewing advertisements, and the like.

In some embodiments, the EGM 10 may implement a responsible gaming system to encourage players to play the game for reasonable amounts of time. As such, if the player has been playing the game for an extended period of time (which may be 30 minutes, 60 minutes, 180 minutes, or any other suitable length of time), as determined by the player looking at the display units 12, 14 substantially continuously over that length of time, the EGM 10 may display graphical game components suggesting the player stop playing the game. In some such embodiments, the EGM 10 may then lock the player out of the game for a certain period of time. This may be implemented alongside facial recognition software to ensure that a locked-out player cannot resume playing until his or her lockout has expired. In situations where multiple EGM 10 are located in close proximity (such as at a casino), the lock out information may be shared amongst EGM 10 to ensure that the player cannot merely resume play at a different terminal.

Figure 7:
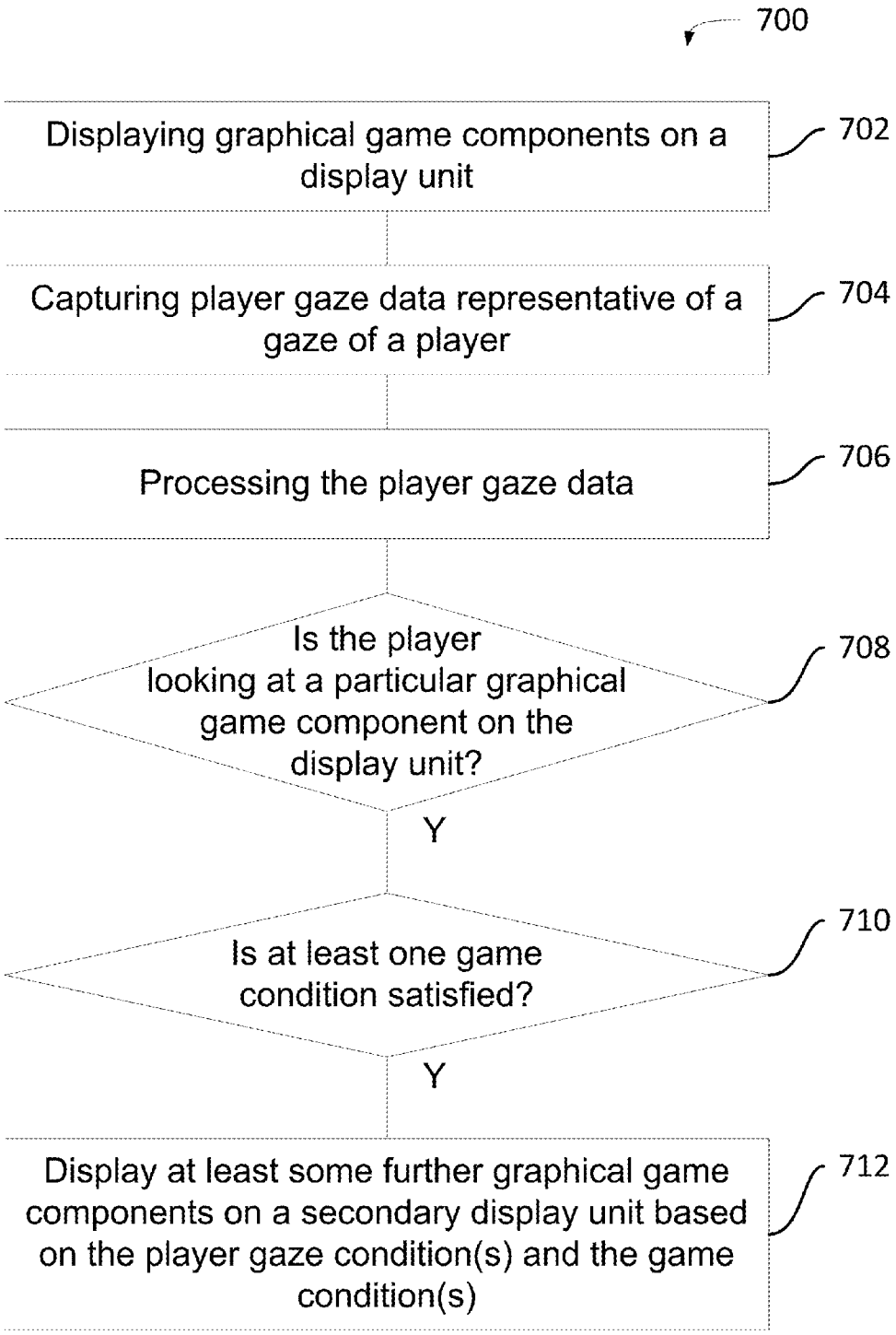
FIG. 7 illustrates a flowchart diagram of an exemplary computer-implemented method for the game component enhancements.

With reference now to FIG. 7, there is provided an exemplary computer-implemented method 700 for displaying graphical game components to a player of the EGM 10, which is illustrated as a flowchart. The method may be implemented, for example, by the EGM 10 which has the display unit 12 and the secondary display unit 14. The graphical game components displayed may be any substantially similar to those discussed supra in relation to the method 500.

In step 702, the EGM 10 displays at least one graphical game component to the player on the display unit 12. The graphical game component(s) may be displayed for example, as a result of an interaction between the player and the EGM 10, processes internal to the EGM 10, at least one timer, or at least one external trigger, which may be based on information collected by the EGM 10 about the external environment, such as by the camera, or due to any other suitable trigger.

In step 704, the EGM 10 captures player gaze data representative of a gaze of the player. Player gaze data may be collected via the camera, or via any other suitable sensor mentioned hereinabove. Player gaze data may be representative of position, orientation, and/or movement of at least one eye of the player, and may provide information about where a player is looking in relation to the EGM 10. This may provide specific information regarding which of the display units 12, 14 the player is looking at and where on the display units 12, 14 the player is looking; additionally, or in the alternative, the player gaze data may indicate a path covered by the gaze of the player across the display units 12, 14, the speed at which the path was traversed, and the like. The player gaze data may be captured in a substantially real-time stream, at periodic intervals, or based on one or more triggers internal or external to the EGM 10. In some cases, the tracking of player gaze data may be a premium feature available to only certain players: premium features may be allocated to players who play games at a certain frequency, or who spend a certain amount of money playing (on the whole or per unit time). Access to premium features may be tied to the player account.

At step 706, the player gaze data captured at step 704 is analyzed by the EGM 10, and more specifically by the game controller board 44. The analysis may be performed in any suitable fashion, including motion detection, edge detection, full-scale detection, and the like. The player gaze data may be analyzed to detect, for example, motion of the player's eyes, as described hereinabove, in three-dimensional space. In some embodiments, the player movement data may be analyzed to determine the location and orientation of the player's eye or eyes, which may include determining a location at which the player is looking, specifically a location on the display unit 12 or the secondary display unit 14 at which the player is looking, as discussed supra. Alternatively, or in addition, the player movement data may be analyzed to determine the direction and/or speed of motion of the player's eye or eyes.

In cases where the analysis of the player gaze data indicates that the player is not looking at either display unit 12 or the secondary display unit 14, the EGM 10 may be interested in the last location on the display unit 12 or the secondary display unit 14 at which the player was looking. As such, the analysis of the player movement data may be stored, temporarily or permanently, in the memory of the game controller board 44.

At step 708, the EGM 10 uses the processed player gaze data to determine if the player is looking at a particular graphical game component on the display unit 12. Here, looking may refer to a gaze action involving the player shifting their gaze to the particular graphical game component and holding their gaze for a certain period of time. Other definitions for "looking", including the player shifting their gaze to the vicinity of the graphical game component, are also considered.

If the player is not looking at the particular graphical game component on the display unit 12, the method 700 continues from step 704, capturing player gaze data and then processing the player gaze data at step 706, until the player does look at the particular graphical game component. If the player does look at the particular graphical game component, the method continues to step 710.

At step 710, the EGM determines if at least one game condition is satisfied. Game conditions in the context of method 700 may be substantially similar to those described hereinabove. If no game condition is satisfied, the method 700 continues from step 704, capturing player gaze data and then processing the player gaze data at step 706, until both at least one player gaze condition and at least one game condition are satisfied. If at least one game condition is found to be satisfied, the method continues to step 712.

In step 712, in response to both at least one player gaze condition and at least one game condition being satisfied, the EGM 10 may display at least some further graphical game components on the secondary display unit 14. The further graphical game component(s) may be based on at least one of the satisfied player gaze condition(s) and the satisfied game condition(s). In some cases, the further graphical game components may be modified versions of the graphical game components displayed on the display unit 12. Alternatively, the further graphical game components may be new graphical game components (i.e., previously undisplayed).

While the method 700 comprises step 712, where at least some further graphical game components are displayed on the secondary display unit 14, it should be noted that the method 700 does not exclude additional steps, including modifying the graphical game components displayed on the display unit 12 if the player is looking at the particular graphical game component on the display unit and if the at least one game condition is satisfied, as this would simply be a specific implementation of the method 500. It should also be noted that the above-presented steps may be repeated as many times as desired in response to further player gaze data being collected (and respective player gaze and game conditions being satisfied). The following paragraphs describe an exemplary embodiment thereof with reference to FIGS. 8A-D.

Figure 8A:
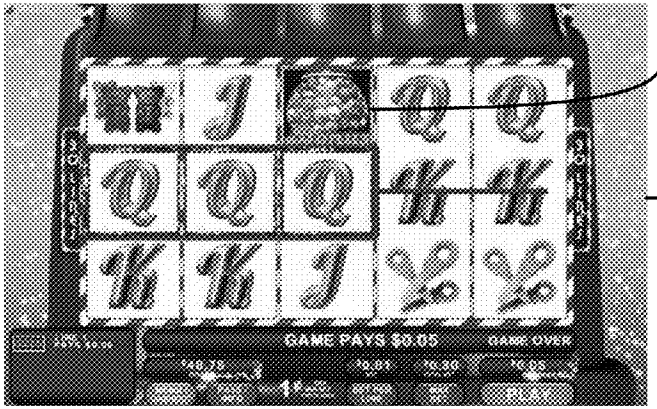
FIGS. 8A-D are illustrative screenshots of game screens of a particular implementation of the method described in FIG. 7.

With reference to FIG. 8A, a player playing a game on EGM 10 may be presented with a game screen 800 on display unit 12. The game screen 800 may be substantively similar to the game screen 600, and may comprise a plurality of graphical game components, including a bonus indicator, such as a bonus box 810 which may be substantively similar to the bonus box 610. In this example, the bonus box 810 is one of a plurality of symbols appearing on reels of a virtual slot machine—it should be noted variations to both the type of game and the particular graphical game components are considered.

In order to begin the bonus game mode provided by the bonus box 810, the player may need to interact with the EGM 10 in at least one particular way. This may include pushing one or more buttons of the keypad 36 and/or the player control buttons 39, and the like; in addition, the player may interact with the display unit 12 in any suitable fashion. In short, the player may interact with the EGM 10 in such a way as to be interpreted by the EGM 10 as the player being desirous of beginning the bonus game mode. Other ways of interacting with the EGM 10 to begin the bonus game mode are also considered. In this embodiment, while the game is played on the display unit 12, the bonus game mode may be played on the secondary display unit 14

Figure 8B:
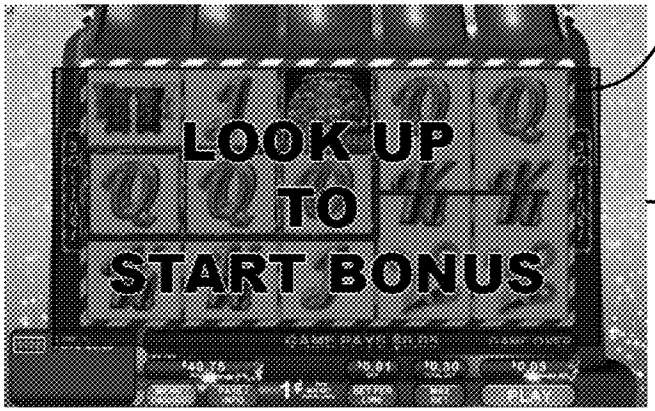

With reference to FIG. 8B, once the bonus game mode has begun, the EGM 10 may display, on the display unit 12, an overlay screen 820 with a message indicating that the bonus game mode has begun. In this case, the message "LOOK UP TO START BONUS" indicates to the player that the bonus game mode has begun on the secondary display unit 14.

Figure 8C:
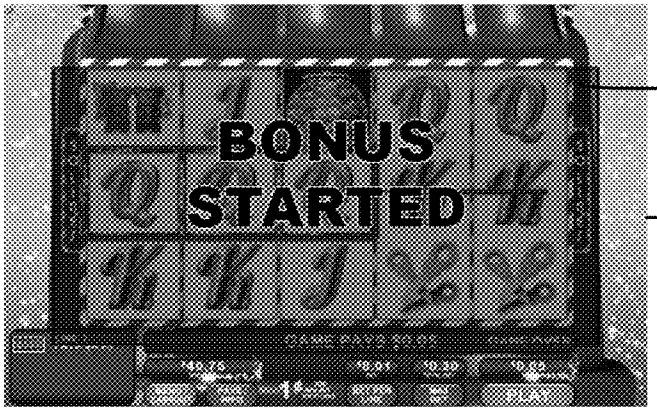

With reference to FIG. 8C, once the player is no longer looking at the display unit 12 (i.e. because he or she is looking at secondary display unit 14), the overlay screen 820 may be replaced with overlay screen 822 with a different message, indicating that the bonus game mode is underway (in this case the message is "BONUS STARTED"). It may be noted that the steps taken by the EGM 10 in FIGS. 8A-8C represent at least one application of the method 500 described above.

Figure 8D:
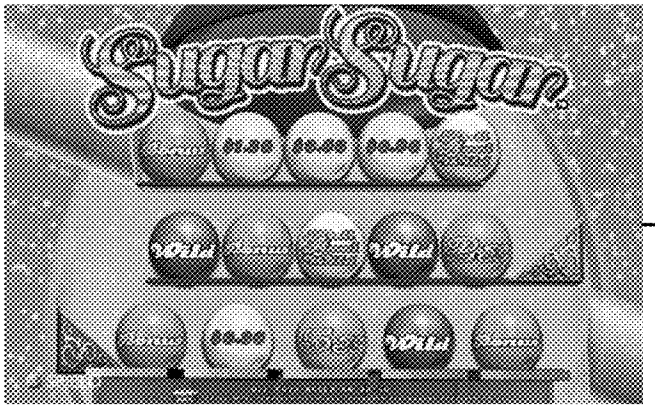

FIG. 8D shows a game screen 850 which may be displayed on the secondary display unit 14 and may be the game screen for the bonus game mode. The bonus game mode may be similar to the game shown in game screen 800, or may be a completely unrelated game. As such, the EGM 10 may capture and process player gaze data to determine where the player is looking on the display unit 12. If the player is looking at a location on the display unit 12 where the bonus box 810 is presented, the EGM 10 causes the bonus game mode to be displayed on the secondary display unit 14.

In some embodiments, the overlay screen 820 may display, alternatively or in addition to the message, a timer which may count down from a predetermined value, indicating to the player that there is only a certain amount of time during which the bonus game mode may be activated.

In some embodiments, the at least one camera, and the display device 12 (and/or the secondary display device 14) may be calibrated. Calibration of the at least one camera and the display devices 12, 14 may be desirable because the eyes of each player using the electronic gaming machine may be physically different, such as the shape and location of the player's eyes, and the capability for each player to see. Each player may also stand at a different position relative to the EGM 10.

The at least one camera may be calibrated by the EGM 10 by detecting the movement of the player's eyes. In some embodiments, the display controller 52 may control the display devices 12, 14 to display one or more calibration symbols. There may be one calibration symbol that appears on the display devices 12, 14 at one time, or more than one calibration symbol may appear on the display devices 12, 14 at one time. The player may be prompted by text or by a noise to direct their gaze to one or more of the calibration symbols. The at least one camera may monitor the gaze of the player looking at the one or more calibration symbols and a distance of the player's eyes relative to the electronic gaming machine to collect calibration data. Based on the gaze corresponding to the player looking at different calibration symbols, the at least one camera may record player gaze data associated with how the player's eyes rotate to look from one position on the display devices 12, 14 to a second position on the display devices 12, 14. The EGM 10 may calibrate the at least one camera based on the calibration data.

Figure 9:
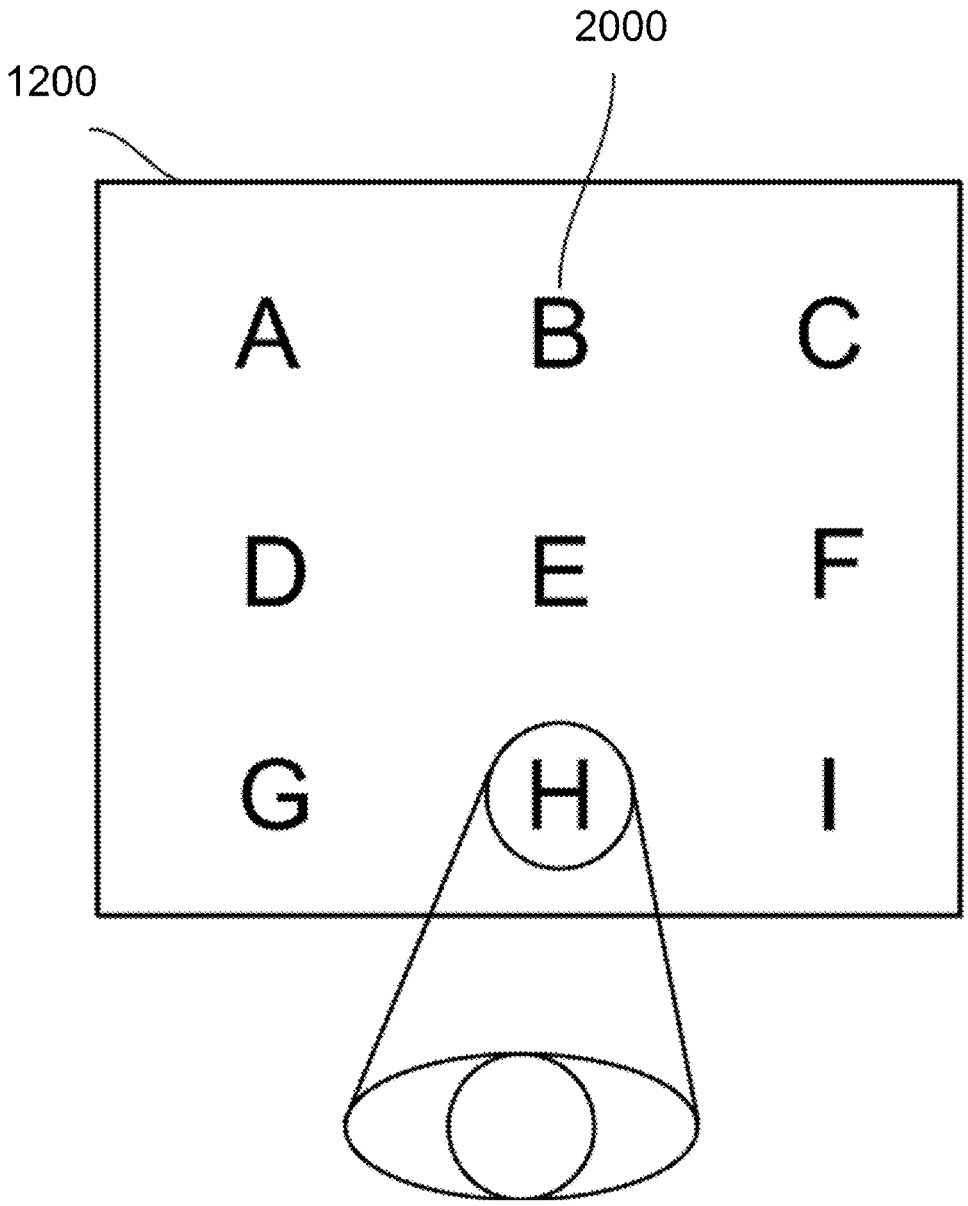
FIG. 9 is a is a schematic diagram illustrating a calibration process for the electronic gaming machine according to some embodiments.

For example, as shown in FIG. 9, before the player plays the interactive game, the EGM 10 may notify the player that the at least one camera and the display devices 12, 14 may be calibrated. The display controller 52 may cause the viewing area 1200 to display nine calibration symbols 2000. In FIG. 9, the calibration symbols 2000 are the letters "A" through "I", but the calibration symbols 2000 may be any other symbols. The calibration symbols 2000 may be located on any portion of the display devices 12, 14. The player may be prompted to look at the nine calibration symbols 2000 in a certain order. The at least one camera may monitor the gaze of the player looking at the nine calibration symbols 2000 and the distance of the player's eyes relative to the electronic gaming machine to collect the calibration data. When the at least one camera collects player gaze data in real time, the EGM 10 may compare the player gaze data with the calibration data in real time to determine the angle at which that the player's eyes are looking.

The display controller 52 may calibrate the display devices 12, 14 using the graphics controller based on the calibration data collected by the at least one camera. The at least one camera may monitor the gaze of the player to collect calibration data as described herein. The display controller 52 may calibrate the display devices 12, 14 using the graphics processor to display a certain resolution on the display devices 12, 14.

Figure 10:
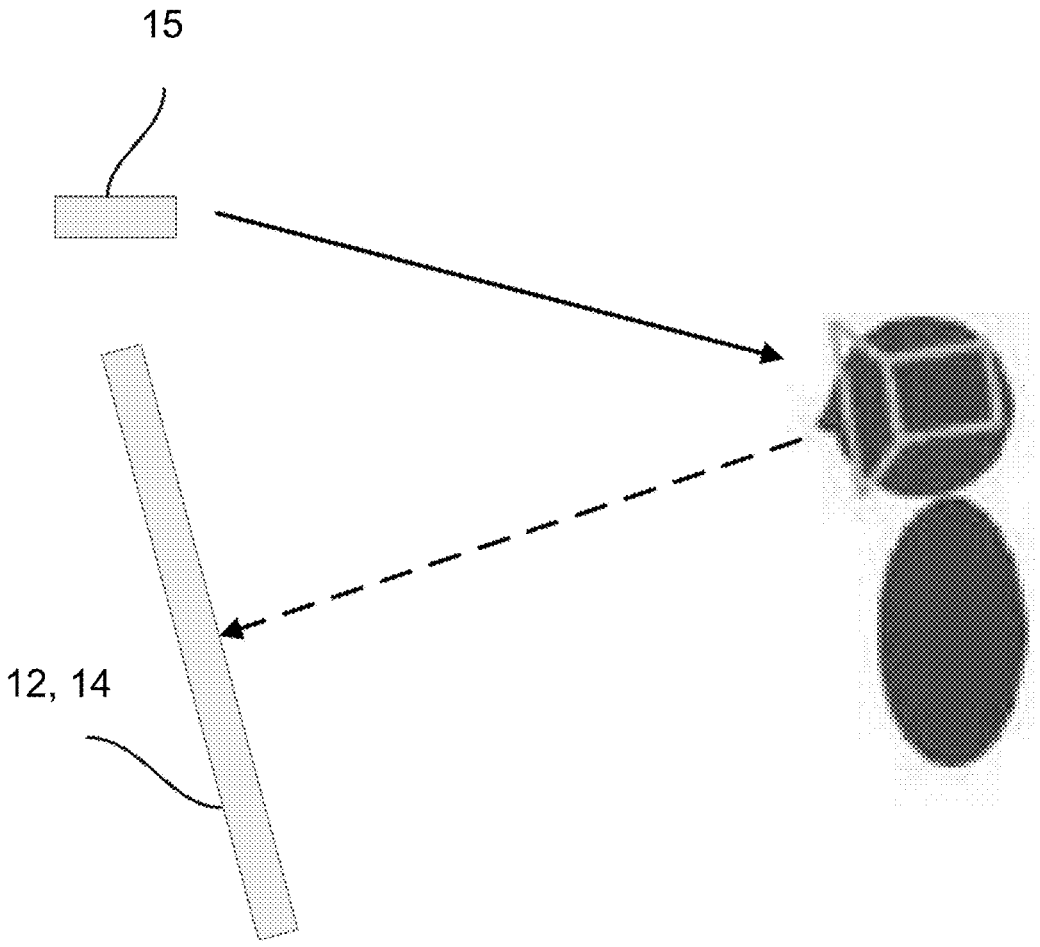
FIG. 10 is a schematic diagram illustrating the mapping of a player's eye gaze to the viewing area according to some embodiments.

In some embodiments, the EGM 10 may determine the location of the gaze relative to the viewing area 1200 based on the position of the player's eyes relative to the electronic gaming machine and an angle of the player's eyes. As shown in FIG. 10, the at least one camera, which may be the camera 15, may monitor the position of the player's eyes relative to the electronic gaming machine, and may also monitor the angle of the player's eyes to collect display mapping data. The angle of the player's eyes may be determined based on the calibration of the at least one camera described herein. The angle of the player's eyes may define the focus of the gaze, which may be a line of sight relative to the display devices 12, 14. Based on the position of the player's eyes relative to the electronic gaming machine and an angle of the player's eyes or the line of sight relative to the display devices 12, 14, the EGM 10 may be configured to determine the direction of an array projecting from the player's eyes. The EGM 10 may determine where the array intersects with the display devices 12, 14, and may determine where the gaze of the player is focused on the display devices 12, 14. The EGM 10 may identify coordinates on the display devices 12, 14 corresponding to the player gaze data and may map the coordinates to the viewing area 1200 to determine the gaze of the player relative to the viewing area 1200. In some embodiments, the gaze of the player may be expressed in three dimensions, depending on whether the interactive game is a two-dimensional game or a three-dimensional game.

While playing an interactive game on the EGM 10, the eyes of a player may move suddenly without the player being conscious of the movement. The eyes of the player may demonstrate subconscious, quick, and short movements, even if the player is not actively controlling their eyes to move in this manner. These subconscious, quick, and short eye movements may affect the determination of the EGM 10 of the gaze of the player based on the player gaze data. Accurate processing of the player gaze data related to these subconscious, quick, and short eye movements may result in detecting the location of the gaze of the player representative of eye twitching or erratic eye movements not reflective of the player's intended gaze, and may be distracting to the player. It may be useful for the player gaze data to be filtered to not reflect these quick and short eye movements, for example, so the determination of the gaze of the player relative to the display units 12, 14 by the EGM 10 reflects the intended gaze of the player. It may also be useful for the portion of the player gaze data representative of the subconscious, quick, and short eye movements to have less determinative effect on the determined location of the gaze of the player. In some embodiments, the EGM 10 may define a filter movement threshold, wherein the EGM 10, prior to determining a location of the gaze of the player relative to the display units 12, 14 using the player gaze data collected by the at least one camera and updating the rendering of the display units 12, 14, determines that the player gaze meets the filter movement threshold.

As discussed supra, the at least one camera may collect player gaze data. The EGM 10 may process the player gaze data to correspond with a location on the viewing area 1200.

The EGM 10 may determine where the player is looking at on the viewing area 1200 based on a certain number of previously recorded player gaze data, for example, by tracking the last ten gaze positions to average out where on the viewing area 1200 the player is looking. The EGM 10 may limit the amount of previously recorded player gaze data that is used to determine where on the viewing area 1200 the player is looking. The EGM 10 may filter out, or "smooth out", player gaze data outside of the pre-determined filter movement threshold, which may represent sudden and subconscious eye movement. The EGM 10 may map the gaze of the player to the viewing area 1200 using at least a portion of the filtered player gaze data to determine the location of the viewing area 1200 at which the player is looking, in order to map the player's gaze to the viewing area 1200. As another example, the EGM 10 may delay in processing the player gaze data associated with subconscious, quick, and short eye movements, so the detected location of the gaze of the player does not represent twitching or sudden unconscious eye movements. Large eye motions may also be associated with more delay in processing and more smoothing. In some embodiments, the EGM 10 may partition the player gaze data associated with large eye motions into data representative of shorter eye motions. The EGM 10 may analyze the player gaze data to determine which player gaze data is associated with subconscious eye movement or with conscious eye movement based on a filter movement threshold, a time threshold, movement threshold, or any combination thereof. Player gaze data associated with quick eye movements over a certain period of time may be determined by the EGM 10 to be subconscious eye movement. The EGM 10 may delay in processing this portion of player gaze data so the detected location of the eye gaze of the player may be stable and may not distract the player, or the EGM 10 may filter out this player gaze data and not process it. Player gaze data associated with large eye movements over a certain period of time may be determined by the EGM 10 to be the player losing focus or being distracted. The EGM 10 may similarly delay in processing this portion of player gaze data or not process this portion of player gaze data. In some embodiments, EGM 10 may filter out, or "smooth out" player gaze data that may exceed the filter movement threshold, in the manner described herein.

The locations where EGM 10 may be used may have a variety of lighting conditions. For example, EGM 10 may be used in a restaurant, a hotel lobby, an airport, and a casino. It may be brighter in some locations and darker in other locations, or the light quality may fluctuate from brightness to darkness. In some embodiments, EGM 10 may include an infrared light source that illuminates the player. The infrared light sources may not interfere with the eyes of the player. In some embodiments, the at least one camera may be an infrared camera. The infrared camera may collect player gaze data without being affected by the lighting conditions of the locations where EGM 10 may be used. In some embodiments, EGM 10 may have a plurality of light sources providing a plurality of spectra of light, and the at least one camera may be a plurality of cameras configured to detect a plurality of spectra of light, so the at least one camera may collect player gaze data without being affected by the lighting conditions of the locations where EGM 10 may be used.

A player that plays an interactive game using EGM 10 may be wearing glasses. The glasses of the player may cause refractions and/or reflections of the light that illuminates the player. This may affect the at least one camera while it monitors the gaze, eye gesture, and/or movement of the player. Glasses that comprise an infrared filter may also interfere with or affect the at least one camera while it monitors the gaze, eye gesture, and/or movement of the player. EGM 10 may recognize that the player may be wearing glasses. For example, as the interactive game commences, display controller 52 may display on display devices 12, 14 using graphics processor a question asking the player if he or she is wearing glasses. The player may provide input indicating whether he or she is wearing glasses, such as, but not limited to, with an audio command, touch command, or with the player's gaze. As other example, the EGM 10 may recognize, based on processing the player gaze data from the at least one camera, that the light illuminating the player may be refracted, and may determine that the player is wearing glasses. When EGM 10 recognizes that the player may be wearing glasses, the EGM 10 may perform additional and/or more stringent filtering functions as described herein to compensate for the player's use of glasses and to accommodate the refractions of the light that illuminates the player. For example, the filter movement threshold may be set to be higher for players who wear glasses.

The game may be played on a standalone video gaming machine, a gaming console, on a general purpose computer connected to the Internet, on a smart phone, or using any other type of gaming device. The video gaming system may include multiplayer gaming features.

The game may be played on a social media platform, such as Facebook™. The video gaming computer system may also connect to a one or more social media platforms, for example to include social features. For example, the video gaming computer system may enable the posting of results as part of social feeds. In some applications, no monetary award is granted for wins, such as in some on-line games. For playing on social media platforms, non-monetary credits may be used for bets and an award may comprise similar non-monetary credits that can be used for further play or to have access to bonus features of a game. All processing may be performed remotely, such as by a server, while a player interface (computer, smart phone, etc.) displays the game to the player.

The functionality described herein may also be accessed as an Internet service, for example by accessing the functions or features described from any manner of computer device, by the computer device accessing a server computer, a server farm or cloud service configured to implement said functions or features.

The above-described embodiments can be implemented in any of numerous ways. For example, the embodiments may be implemented using hardware, software or a combination thereof. When implemented in software, the software code can be executed on any suitable processor or collection of processors, whether provided in a single computer or distributed among multiple computers. Such processors may be implemented as integrated circuits, with one or more processors in an integrated circuit component. A processor may be implemented using circuitry in any suitable format.

Further, it should be appreciated that a computer may be embodied in any of a number of forms, such as a rack-mounted computer, a desktop computer, a laptop computer, or a tablet computer. Additionally, a computer may be embedded in a device not generally regarded as a computer but with suitable processing capabilities, including an EGM, A Web TV, a Personal Digital Assistant (PDA), a smart phone, a tablet or any other suitable portable or fixed electronic device.

Also, a computer may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards and pointing devices, such as mice, touch pads, and digitizing tablets. As another example, a computer may receive input information through speech recognition or in other audible formats.

Such computers may be interconnected by one or more networks in any suitable form, including as a local area network or a wide area network, such as an enterprise network or the Internet. Such networks may be based on any suitable technology and may operate according to any suitable protocol and may include wireless networks, wired networks or fiber optic networks.

The various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, the enhancements to game components may be embodied as a tangible, non-transitory computer readable storage medium (or multiple computer readable storage media) (e.g., a computer memory, one or more floppy discs, compact discs (CD), optical discs, digital video disks (DVD), magnetic tapes, flash memories, circuit configurations in Field Programmable Gate Arrays or other semiconductor devices, or other non-transitory, tangible computer-readable storage media) encoded with one or more programs that, when executed on one or more computers or other processors, perform methods that implement the various embodiments discussed above. The computer readable medium or media can be transportable, such that the program or programs stored thereon can be loaded onto one or more different computers or other processors to implement various aspects as discussed above. As used herein, the term "non-transitory computer-readable storage medium" encompasses only a computer-readable medium that can be considered to be a manufacture (i.e., article of manufacture) or a machine.

The terms "program" or "software" are used herein in a generic sense to refer to any type of computer code or set of computer-executable instructions that can be employed to program a computer or other processor to implement various aspects of the present invention as discussed above. Additionally, it should be appreciated that according to one aspect of this embodiment, one or more computer programs that when executed perform methods as described herein need not reside on a single computer or processor, but may be distributed in a modular fashion amongst a number of different computers or processors to implement various aspects.

Computer-executable instructions may be in many forms, such as program modules, executed by one or more computers or other devices. Generally, program modules include routines, programs, objects, components, data structures, etc., that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that conveys relationship between the fields. However, any suitable mechanism may be used to establish a relationship between information in fields of a data structure, including through the use of pointers, tags or other mechanisms that establish relationship between data elements.

Various aspects of the present game enhancements may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments. While particular embodiments have been shown and described, it will be obvious to those skilled in the art that changes and modifications may be made without departing from this invention in its broader aspects. The appended claims are to encompass within their scope all such changes and modifications.

The invention claimed is:

1. An electronic gaming device, comprising:

at least one data storage unit to store game data for a game played by a player, the game data comprising at least one game condition and at least one player gaze condition;

first and second display units to display, via a shared graphical user interface, graphical game components to the player in accordance with the game data;

at least one data capture unit to collect player gaze data representative of a gaze of the player, the data capture device comprising a camera; and at least one processor, configured to:

process the player gaze data to determine whether the player is looking at a bonus game indicator displayed on the first display unit;

if the player is looking at the bonus game indicator, determine whether the at least one game condition is satisfied while the player gaze condition is satisfied; and if the at least one game condition is satisfied while the player gaze condition is satisfied, display a bonus game on the second display unit, the bonus game selected based on the at least one satisfied game condition.

2. The electronic gaming device of claim 1, wherein the processor is further configured to modify at least some of the graphical game components displayed on the first display unit.

3. The electronic gaming device of claim 2, wherein modifying at least some graphical game components displayed on the first display unit comprises overlaying a message over the at least some graphical game components.

4. The electronic gaming device of claim 2, wherein modifying at least some graphical game components displayed on the first display unit comprises altering a duration of a timeout timer.

* * * * *